US008741130B2

(12) United States Patent
Nguyen et al.

(10) Patent No.: US 8,741,130 B2
(45) Date of Patent: Jun. 3, 2014

(54) METHOD FOR RESOLVING EMULSIONS IN ENHANCED OIL RECOVERY OPERATIONS

(75) Inventors: Duy T. Nguyen, Houston, TX (US); G. Richard Meyer, Missouri City, TX (US)

(73) Assignee: Nalco Company, Naperville, IL (US)

( * ) Notice: Subject to any disclaimer, the term of this patent is extended or adjusted under 35 U.S.C. 154(b) by 621 days.

(21) Appl. No.: 12/756,647

(22) Filed: Apr. 8, 2010

(65) Prior Publication Data

US 2011/0247965 A1 Oct. 13, 2011

(51) Int. Cl.
*C10G 33/04* (2006.01)

(52) U.S. Cl.
USPC ..... 208/188

(58) Field of Classification Search
USPC ..... 208/188, 236; 507/221, 222
See application file for complete search history.

(56) References Cited

U.S. PATENT DOCUMENTS

| | | | | |
|---|---|---|---|---|
| 4,018,278 | A | 4/1977 | Shupe | |
| 4,293,428 | A | 10/1981 | Gale et al. | |
| 4,374,734 | A * | 2/1983 | Newcombe | 210/708 |
| 4,444,654 | A * | 4/1984 | Cargle et al. | 208/188 |
| 4,559,148 | A | 12/1985 | Ashrawi et al. | |
| 5,045,212 | A | 9/1991 | Augustin et al. | |
| 5,097,904 | A | 3/1992 | Himes | |
| 6,214,236 | B1 | 4/2001 | Scalliet | |
| 2012/0053092 | A1 * | 3/2012 | Marangoni et al. | 507/131 |

OTHER PUBLICATIONS

Krister Holmberg, Bo Johnson, Begt Kronberg and Bjorn Lindman Surfactants and Polymers in Aqueous Solution Second edition pp. 1-547.*

Avranas & Stalidis, "Effect of a Cationic Surfactant on a Nonionic Surfactant Stabilized Emulsion," Journal of Colloid and Interface Science, vol. 43, 1991, pp. 180-187.

Hafiz et al., "Chemical destabilization of oil-in-water emulsion by novel polymerized diethanolamines," Journal of Colloid and Interface Science, vol. 284, 2005, pp. 167-175.

Ruiquan et al., "Characterization and demulsification of produced liquid from weak base ASP flooding," Colloids and Surfaces, vol. 290, 2006, pp. 164-171.

Comeau et al., "Micellar Properties of Two-Headed Surfactant Systems: The Disodium 1,2-alkanedisulfates," Can. J. Chem., vol. 73, pp. 1741-1745, 1995.

Sekhon, "Gemini (Dimeric) Surfactants," Resonance, pp. 42-49, Mar. 2004.

* cited by examiner

*Primary Examiner* — Randy Boyer
*Assistant Examiner* — Juan Valencia
(74) *Attorney, Agent, or Firm* — Edward O. Yonter

(57) ABSTRACT

Disclosed and claimed is a method of demulsifying a produced emulsion into oil and water by adding a surfactant to the produced emulsion. The surfactant comprises any combination of surfactants having a plurality of hydrophilic groups.

12 Claims, No Drawings

METHOD FOR RESOLVING EMULSIONS IN ENHANCED OIL RECOVERY OPERATIONS

FIELD OF THE INVENTION

This invention relates generally to the field of enhanced oil production and recovery. More specifically, the invention relates to the field of recovery of crude oil from produced emulsions of surfactant-polymer enhanced oil recovery floods. The invention has particular relevance to the use of surfactants comprising a plurality of hydrophilic groups.

BACKGROUND OF THE INVENTION

The production of crude oil from reservoirs typically results in significant quantities of non-produced crude oil remaining in the reservoir. After primary oil recovery has been performed, secondary recovery (typically involving water injection), is frequently begun to produce trapped oil. Frequently, much oil remains in the reservoir and tertiary recovery operations have been developed to produce the remaining oil. Most tertiary recovery methods for recovering such remaining crude oil include surfactant-polymer enhanced oil recovery floods, such as injecting combination of surfactants and polymers in brine solutions into the reservoir. Other methods for enhanced oil recovery may include gas injection, chemical injection, ultrasonic stimulation, microbial injection, and thermal recovery. If the oil recovered using enhanced oil recovery floods cannot be efficiently treated (e.g., the emulsion broken into dry oil and clean water), then most if not all oil producers will be reluctant to conduct chemical floods in favor of other less aggressive and lower recovery processes.

Results of such conventional methods include a produced emulsion that typically contains crude oil, water, surfactant, and polymer. Drawbacks include difficulties in separating the emulsion into clean water and dry oil for efficient recovery of the crude oil and proper disposal of the water in an environmentally safe manner. Heat has been used to aid in resolving such emulsions but is not economical due to the large amounts of water involved. Solvent extraction is disclosed in U.S. Pat. No. 4,559,148, "Method of Extracting and Reutilizing Surfactants from Emulsions," but is also not practical due to the large capital investment and flammable solvent handling issues.

Consequently, there is a need for improved methods of resolving the crude oil and water emulsions. Additional needs include improved methods for demulsifying the produced emulsion to produce a clean separation of the crude oil and water.

BRIEF SUMMARY OF THE INVENTION

Accordingly, the present invention provides a method for resolving emulsions produced through an enhanced oil recovery process. In an aspect, the method includes adding a composition comprising one or more surfactants having a plurality of hydrophilic groups. Particularly preferred surfactants comprise one or more bolaform or one or more gemini surfactants to break oil-in-water emulsions. Preferably, the bolaform and/or gemini surfactants are cationic.

In an aspect, this invention meets the previously unmet need of efficiently demulsifying an emulsion comprising water and oil. The emulsions applicable in the method of the invention are preferably derived from an enhanced oil recovery process, though the method has equal applicability to any emulsions encountered in the art.

It is an advantage of the invention to provide a novel method of resolving an emulsion comprising oil and water.

It is another advantage of the invention to provide a novel method of efficiently resolving an emulsion comprising oil and water that was derived from an enhanced oil recovery process.

It is a further advantage of the invention to provide a novel method of resolving an emulsion comprising oil and water utilizing any combination of bolaform and/or gemini surfactants.

It is yet another advantage of the invention to provide a novel method of resolving an emulsion comprising oil and water resulting in dry oil and clean water.

The foregoing has outlined rather broadly the features and technical advantages of the present invention in order that the detailed description of the invention that follows may be better understood. Additional features and advantages of the invention will be described hereinafter that form the subject of the claims of the invention. It should be appreciated by those skilled in the art that the conception and the specific embodiments disclosed may be readily utilized as a basis for modifying or designing other embodiments for carrying out the same purposes of the present invention. It should also be realized by those skilled in the art that such equivalent embodiments do not depart from the spirit and scope of the invention as set forth in the appended claims

DETAILED DESCRIPTION OF THE INVENTION

This invention comprises a method of treating an emulsion comprising oil and water derived from an oil recovery process. A preferred area of the method of the invention is emulsions derived from enhanced oil recovery processes where oil remaining in a reservoir after conventional recovery methods have been exhausted is produced through, for example, a polymer-surfactant flood. It should, however, be appreciated that the method of the invention has equal application to emulsions derived from any conventional or enhanced oil recovery operation. The objective of the present invention is to provide a method of resolving emulsions resulting in dry oil and clean water.

The emulsion produced from an enhanced oil recovery process is typically stabilized with surfactants and polymers. The method of the invention is applicable to any enhanced or tertiary oil recovery process. Exemplary methods of producing oil through such enhanced oil recovery processes are disclosed in U.S. Pat. No. 4,293,428, "Propoxylated Ethoxylated Surfactants and Method of Recovering Oil Therewith" and U.S. Pat. No. 4,018,278, "Surfactant Oil Recovery Process Usable in High Temperature Formations." In the method of the invention, emulsions are treated by any combination of surfactants having a plurality of hydrophilic groups. Preferred surfactants comprise bolaform and/or gemini surfactants to demulsify emulsions produced, for example, by surfactant-polymer enhanced oil recovery floods and recover dry oil and clean water. In such embodiments, the produced emulsions typically contain at least water, crude oil, surfactants, and polymers. Addition of the composition to the produced emulsion separates the oil and water phases. In some embodiments, the separation is a clean separation of oil and water. A clean separation generally refers to dry oil with less than about 1% total sediment and water, a good interface with sharp separation between oil and water, and clean water with less than about 300 parts per million (ppm) residual oil. The composition is added to the emulsion by any suitable method. (See e.g., Z. Ruiquan et al., "*Characterization and demulsification of produced liquid from weak base ASP flooding*,"

Colloids and Surfaces, Vol. 290, pgs 164-171, (2006); U.S. Pat. Nos. 4,374,734 and 4,444,654).

In contrast to conventional surfactants that generally have one hydrophilic group and one hydrophobic group, both bolaform and gemini surfactants have two hydrophilic groups. Such surfactants are typically about 10 to about 1,000 times more surface active than conventional surfactants with similar but single hydrophilic and hydrophobic groups in the molecule. These surfactants also have remarkably low critical micelle concentration (CMC) values compared to the corresponding conventional surfactants of equivalent chain length.

Bolaform surfactants refer to surfactants that have two hydrophilic groups and one hydrophobic group, and generally have the two hydrophilic groups at both ends of a nonpolar chain. Examples of bolaform surfactants and methods of synthesizing such molecules are disclosed in Comeau et al., "*Micellar Properties of Two-Headed Surfactant Systems: The Disodium* 1,2-*alkanedisulfates*," Can. J. Chem., 73: 1741-1745 (1995). In embodiments of this invention, any suitable bolaform surfactant may be used. Molecular weights of such surfactants are preferably in the range of about 150 to about 900 daltons (Da), with about 200 to about 800 Da being more preferred. Representative bolaform surfactants include alkyl-bis(trimethylammonium halide), alkyl-bis(benzyldimethylammonium halide), alkyl-bis(amidopropyl-N-benzyl-N,N-dimethylammonium halide), and alkyl-bis(amidopropyl-N,N,N-trimethylammonium halide). The aforementioned bolaform surfactants have an average alkyl chain length of $C_6$ to $C_{24}$, alternatively an average alkyl chain length of $C_6$ to $C_{16}$ or $C_{12}$ to $C_{18}$, and a further alternative of $C_{10}$. Without limitation, examples of halides present in these bolaform surfactants include fluoride, chloride, bromide, iodide, astatide, or any combination thereof.

Gemini surfactants refer to surfactants that have two hydrophilic and two hydrophobic groups, and generally are amphiphilic having two hydrocarbon tails and two ionic groups linked by a spacer, wherein the spacer may be $C_2$-$C_{12}$. These components generally are in the order hydrocarbon tail-ionic group-spacer-ionic group-hydrocarbon tail. Examples of gemini surfactants and methods of synthesizing such surfactants are disclosed in Sekhon, "*Gemini* (*dimeric*) *Surfactants*," Resonance, 42-49 (March 2004). In embodiments of this invention any suitable gemini surfactant may be used. Molecular weights of such surfactants are preferably in the range of about 150 to about 1,500 Da, with about 200 to about 1,000 Da being more preferred. Representative gemini surfactants include ($C_2$-$C_{12}$)-bis(dimethyl alkylammonium halide), ($C_2$-$C_{12}$)-bis(methyl benzyl alkylammonium halide). The ($C_2$-$C_{12}$)-bis(dimethyl alkylammonium halide) and ($C_2$-$C_{12}$)-bis(methyl benzyl alkylammonium halide) have an average alkyl chain length of $C_1$ to $C_{16}$, alternatively $C_1$ to $C_{10}$ or $C_{12}$ to $C_{18}$, and further alternatively of $C_8$. Without limitation, examples of halides include fluoride, chloride, bromide, iodide, astatide, or any combination thereof.

The disclosed cationic surfactant composition may have any desirable amount of active material. In an embodiment, the cationic surfactant has from about 30 wt % to about 60 wt % active material. Alternatively, the composition has from about 40 wt % to about 70 wt %, and further alternatively the composition has from about 50 wt % to about 90 wt % active material.

Embodiments further include a composition having the surfactant and a solvent. The solvent may be any solvent suitable, for example, for dissolving or suspending the surfactant. In embodiments, the solvent is water, alcohol, an organic solvent, or any combination thereof. The alcohol may include any alcohol suitable as a solvent and for use with oil recovery operations. Without limitation, examples of suitable alcohols include glycol, isopropyl alcohol, methanol, butanol, or any combination thereof. According to an embodiment, the organic solvent includes aromatic compounds, either alone or in any combination with the foregoing. In an embodiment, the aromatic compounds have a molecular weight from about 70 to about 400, alternatively from about 100 to about 200. Without limitation, examples of suitable aromatic compounds include toluene, xylene, naphthalene, ethylbenzene, trimethylbenzene, and heavy aromatic naphtha (HAN), other suitable aromatic compounds, and any combination of the foregoing. It is to be understood that the amount of surfactant in the composition in relation to the solvent may vary in some embodiments depending upon factors such as temperature, time, and type of surfactant. For instance, without limitation, a higher ratio of surfactant to solvent may be used if a faster reaction time is desired.

The composition may also be added to the emulsion in any suitable amount. In an embodiment, the composition is added in an amount from about 50 ppm to about 20,000 ppm, based on actives and total emulsion volume. In alternative embodiments, from about 100 ppm to about 10,000 ppm of the surfactant, further alternatively from about 200 ppm to about 10,000 ppm surfactant, and further alternatively from about 200 ppm to about 500 ppm surfactant is added to the emulsion, based on actives and total emulsion volume.

In embodiments, the disclosed composition is used in conjunction with other surfactants or additives. These other surfactants or additives may be added as part of the same composition or as a separate composition and may be added simultaneously or sequentially. For example, the composition may be added to the produced emulsion with a polymeric nonionic surfactant. Without limitation, examples of suitable polymeric nonionic surfactants include polysorbates, fatty alcohols such as cetyl alcohol and oleyl alcohol, copolymers of polyethylene oxide, copolymers of polypropylene oxide, alkyl polyglucosides such as decyl maltoside, alkylphenol polyethylene oxide, alkyl polyethylene oxide, and ethoxylated propoxylated alkyl phenol-formaldehyde resin chemistry. The polymeric nonionic surfactant is typically dissolved or suspended in a solvent. Any solvent suitable for dissolving or suspending a polymeric nonionic surfactant may be used. Without limitation, examples of suitable solvents include water, ether, alcohol, toluene, xylene, heavy aromatic naphtha (HAN), other suitable organic solvents, or any combination thereof. The alcohol may include any alcohol suitable for use with oil recovery and for dissolving the polymeric nonionic surfactant. In an embodiment, the polymeric nonionic surfactant is dissolved or suspended in a solvent.

In an embodiment, the composition and the polymeric nonionic surfactant are added to the produced emulsion in a weight ratio of composition to polymeric nonionic surfactant from about 9:1, alternatively from about 1:1. In embodiments, the composition and polymeric nonionic surfactant are added about simultaneously (either as separate formulations or as part of the same formulation) or sequentially to the produced emulsion. Without being limited by theory, simultaneous addition to the produced emulsion of the composition and a polymeric nonionic surfactant generally provide improved quality of separated oil and aqueous phases. For instance, the simultaneous addition to the produced emulsion of the disclosed composition and water with a polymeric nonionic surfactant dissolved in an organic solvent improved the quality of the separated oil and aqueous phases.

The foregoing may be better understood by reference to the following examples, which are intended for illustrative purposes and are not intended to limit the scope of the invention.

The tests that produced the data in Tables 1 and 2 were conducted in graduated six ounce prescription bottles to allow for rapid water drop readings. All bottles used 100 ml of emulsion. After pouring the emulsion followed by chemical addition, the bottles were allowed to reach the desired temperature via a water bath. Upon reaching the desired temperature, the samples were shaken via a mechanical shaker and then returned to the water bath. Water drop readings were recorded in millimeters, and the values were reported as a percentage of total water content in the emulsion. The values were also used to gauge emulsion stability, where a higher percentage water drop indicated lower emulsion stability. As can be seen in Table 1, the present invention is very effective at resolving the emulsion. Cocktails 1 and 2 are fluids that were injected into the reservoir to enhance oil recovery. The produced emulsion was then subjected to the described testing.

TABLE 1

Bottle test results of demulsification studies of an Alkaline Surfactant Polymer (ASP) process.

| Species | Cocktail 1 | Cocktail 2 |
|---|---|---|
| NaCl (g/L) | 3.115 | 3.115 |
| $CaCl_2$•2H2O (g/L) | 0.096 | 0.096 |
| $MgCl_2$•6H2O (g/L) | 0.093 | 0.093 |
| $NaHCO_3$ (g/L) | 1.310 | 1.310 |
| KCl (g/L) | 0.054 | 0.054 |
| $Na_2SO_4$ (g/L) | 0.236 | 0.236 |
| Surfactant A, ppm | 1,500 | — |
| Surfactant B, ppm | 1,500 | — |
| Surfactant C, ppm | — | 1,500 |
| Surfactant D, ppm | — | 1,500 |
| Diethylene glycol monobutyl ether (DGBE), ppm | 10,000 | 10,000 |
| $Na_2CO_3$, ppm | 10,000 | 10,000 |
| Polymer #1, ppm | 1,500 | 1,500 |

A very low concentration of the surfactant was used to achieve ultra low interfacial tension between the trapped oil and the injection fluid/formation water. The ultra low interfacial tension also allowed the alkali present in the injection fluid to penetrate deeply into the formation and contact the trapped oil globules. The alkali then reacted with the acidic components in the crude oil to form additional surfactant in-situ to continuously provide ultra low interfacial tension and free the trapped oil. In the ASP Process, polymer was used to increase the viscosity of the injection fluid, to minimize channeling, and provide mobility control. The demulsification was performed at 60° C. using a mixture of chain lengths C8/C9/C10-bis-(amidopropyl-N-benzyl-N,N-dimethyl ammonium bromide).

TABLE 1

| | | | Water Drop, % | | | | |
|---|---|---|---|---|---|---|---|
| ASP solution | Oil Cut | Dose (ppm) | 30 min | 1 hr | 2 hrs | 4 hrs | Over-night |
| Cocktail 1 | 10% | 500 | 100 | 100 | — | 100 | 100 |
| | Oil | 1000 | 100 | 100 | — | 100 | 100 |
| | Cut | 2000 | 100 | 100 | — | 100 | 100 |
| | | 3000 | 100 | 100 | — | 100 | 100 |
| | | 4000 | 100 | 100 | — | 100 | 100 |
| | 50% | 1000 | 0 | 76E(*) | 80E | 80 | 80 |
| | Oil | 2000 | 90 | 94 | 94 | 94 | 94 |
| | Cut | 3000 | 80 | 86 | 90 | 90 | 90 |
| | | 4000 | 84 | 90 | 90 | 86 | 90 |
| | | 5000 | 90 | 90 | 88 | 86 | 90 |
| | | 6000 | 84 | 90 | 90 | 86 | 90 |
| Cocktail 2 | 10% | 500 | 100 | 100 | 100 | 100 | 100 |
| | Oil | 1000 | 100 | 100 | 100 | 100 | 100 |
| | Cut | 2000 | 100 | 100 | 100 | 100 | 100 |
| | 50% | 1000 | 0 | 0 | 0 | 0 | 64E |
| | Oil | 2000 | 84 | 82 | 90 | 92 | 94 |
| | Cut | 3000 | 86 | 88 | 88 | 88 | 92 |
| | | 4000 | 92 | 88 | 88 | 88 | 90 |
| | | 5000 | 92 | 92 | 92 | 90 | 90 |

TABLE 1-continued

| | | | Water Drop, % | | | | |
|---|---|---|---|---|---|---|---|
| ASP solution | Oil Cut | Dose (ppm) | 30 min | 1 hr | 2 hrs | 4 hrs | Over-night |
| Untreated | 10% Oil Cut | 0 | 0 | 0 | 87E | — | 100E |

(*) Water drop number with an "E" designation indicates the water phase is oil-in-water emulsion (dirty water)

In the test results presented in Table 2, oil drop readings were recorded as opposed to water drop readings and were converted to the percentage of oil content (Table 2). The procedure was the same as described above for the results of Table 1. Following the oil drop readings, the resolved or partially resolved oil from each bottle was analyzed for water content. Using a syringe with a needle, a small portion of the oil (about 6 ml) was withdrawn. This aliquot of oil was added to a graduated API centrifuge tube containing an equal volume of an aromatic solvent and the contents were shaken by hand. Following centrifugation, the percent residual emulsion, typically referred to as bottom settlings (BS), was noted for each bottle. After recording BS values, alkyl sulfonate surfactant (a chemical known to resolve the remaining emulsion) was added to the centrifuge tube. Such chemicals are generally called "slugging or knockout chemicals" and are typically low molecular weight sulfonate-based materials. After slugging, the tube was again shaken and centrifuged as previously described. The BS was thus completely eliminated and only water remained in the bottom part of the tube. The slug grindout number is reported as a percentage. Smaller values of BS and slug indicate drier oil.

TABLE 2

Bottle test results of demulsification studies of a surfactant flood emulsion.

| | | Oil drop, % | | | | | Thief Grindout | |
|---|---|---|---|---|---|---|---|---|
| Treatment | Ppm | 0.5 hr | 1 hr | 2 hr | 4 hr | 20 hr | BS | Slug |
| Untreated | 0 | 0 | 8 | 16 | 52 | 72 | 15.2 | 6.0 |
| 1 | 500 | 12 | 72 | 72 | 72 | 88 | 0.76 | 0.78 |
| 1 | 2,000 | 76 | 84 | 84 | 84 | 88 | N/A | N/A |
| 1 | 4,000 | 80 | 96 | 96 | 96 | 96 | N/A | N/A |
| 2 | 2,000 | 100 | 100 | 100 | 100 | 100 | 0.6 | 0.62 |

In Table 2, Treatment 1 is the conventional cationic surfactant (alkyldimethyl benzylammonium chloride) with one hydrophobic group and one hydrophilic group. Treatment 2 is an embodiment of the present invention (C8/C9/C10-bis-(amidopropyl-N-benzyl-N,N-dimethyl ammonium bromide)). As can be seen, Treatment 2 was much more effective than the conventional surfactant at resolving the emulsion as indicated by a higher value of oil drop. For example, at 2,000 ppm Treatment 2 is more effective than Treatment 1 at 4,000 ppm All of the compositions and methods disclosed and claimed herein can be made and executed without undue experimentation in light of the present disclosure. While this invention may be embodied in many different forms, there are described in detail herein specific preferred embodiments of the invention. The present disclosure is an exemplification of the principles of the invention and is not intended to limit the invention to the particular embodiments illustrated.

Any ranges given either in absolute terms or in approximate terms are intended to encompass both, and any definitions used herein are intended to be clarifying and not limiting. Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all subranges (including all fractional and whole values) subsumed therein.

Furthermore, the invention encompasses any and all possible combination of some or all of the various embodiments described herein. Any and all patents, patent applications, scientific papers, and other references cited in this application, as well as any references cited therein, are hereby incorporated by reference in their entirety. It should also be understood that various changes and modifications to the presently preferred embodiments described herein will be apparent to those skilled in the art. Such changes and modifications can be made without departing from the spirit and scope of the invention and without diminishing its intended advantages. It is therefore intended that such changes and modifications be covered by the appended claims.

The claimed invention is:

1. A method of demulsifying an emulsion comprising water and oil, the method comprising adding an effective amount of a composition comprising a cationic surfactant to the emulsion to form a mixture and optionally applying heat to the mixture, wherein the cationic surfactant comprises one or more bolaform surfactants, one or more gemini surfactants, or any combination of the foregoing;

wherein the bolaform surfactant is selected from the group consisting of: alkyl-bis(trimethylammonium halide); alkyl-bis(benzyldimethyl ammonium halide); alkyl-bis (amidopropyl-N-benzyl-N,N-dimethylammonium halide); alkyl-bis(amidopropyl-N,N,N-trimethylammonium halide); and any combination thereof, wherein the bolaform surfactant has an average alkyl chain length of $C_6$ to $C_{24}$; and wherein the gemini surfactant is selected from the group consisting of: ($C_2$-$C_{12}$)-bis(dimethylalkylammonium halide), ($C_2$-$C_{12}$)-bis(methylbenzyl alkylammonium halide), and any combination of thereof, wherein the ($C_2$-$C_{12}$)-bis(dimethylalkylammonium halide) and ($C_2$-$C_{12}$)-bis(methylbenzyl alkylammonium halide) have an average alkyl chain length of $C_6$ to $C_{16}$.

2. The method of claim 1, wherein the halide is selected from the group consisting of: fluoride, chloride, bromide, iodide, astatide, and any combination thereof.

3. The method of claim 1, wherein the ($C_2$-$C_{12}$)-bis(dimethylalkylammonium halide) and ($C_2$-$C_{12}$)-bis(methylbenzyl alkylammonium halide) have an average chain length of $C_6$ to $C_{10}$.

4. The method of claim 1, wherein the halide is selected from the group consisting of: fluoride, chloride, bromide, iodide, or any combination thereof.

5. The method of claim 1, wherein the composition comprises from about 30 to about 90 wt % active material of the cationic surfactant.

6. The method of claim 1, wherein the composition further comprises an organic solvent, water, and any combination thereof.

7. The method of claim 6, wherein the organic solvent comprises an alcohol, an ether, an aromatic compound, or any combination thereof.

8. The method of claim 1, wherein the effective amount of the composition comprises from about 50 ppm to about 20,000 ppm, based on actives and total emulsion volume.

9. The method of claim 1, further comprising adding a polymeric nonionic surfactant to the emulsion.

10. The method of claim 9, wherein the composition and the polymeric nonionic surfactant are added to the emulsion in a weight ratio of about 9:1 to about 1:1.

11. The method of claim 9, wherein the polymeric nonionic surfactant and the composition are added about simultaneously to the emulsion.

12. The method of claim 1, wherein the emulsion is a produced emulsion from an enhanced oil recovery operation.

* * * * *